US006931978B1

(12) United States Patent
Dionne

(10) Patent No.: US 6,931,978 B1
(45) Date of Patent: Aug. 23, 2005

(54) REBOUND ATTENUATION DEVICE FOR AUTOMATIC FIREARMS

(75) Inventor: Sylvain Dionne, Mirabel (CA)

(73) Assignee: SNC Technologies Inc., Le Gardeur (CA)

( * ) Notice: Subject to any disclaimer, the term of this patent is extended or adjusted under 35 U.S.C. 154(b) by 0 days.

(21) Appl. No.: 10/780,890

(22) Filed: Feb. 19, 2004

(51) Int. Cl.[7] ..... F41A 19/02
(52) U.S. Cl. ..... 89/194; 89/199; 89/128; 89/130; 89/183; 42/69.02
(58) Field of Search ..... 42/69.02, 1.06; 89/194, 198, 199, 4.5, 130, 128, 180, 183

(56) References Cited

U.S. PATENT DOCUMENTS 4,227,439 A * 10/1980 Gillum ..... 89/190
H926 H * 6/1991 Mahtook ..... 89/128
6,829,974 B1 * 12/2004 Gwinn, Jr. ..... 89/130

* cited by examiner

*Primary Examiner*—J. Woodrow Eldred
(74) *Attorney, Agent, or Firm*—David J. French

(57) ABSTRACT

A blow-back operating automatic firearm has a sliding mass carried with its bolt carrier assembly to increase the dwell time of the bolt at the breech when the bolt is in battery position for firing. The sliding mass reduces the tendency of the bolt to bounce-off the head end of the seated cartridge, thereby reducing the risk that a misfiring will occur.

12 Claims, 9 Drawing Sheets

REBOUND ATTENUATION DEVICE FOR AUTOMATIC FIREARMS

FIELD OF INVENTION

This invention relates to the field of automatic firearms incorporating a blow-back firing mechanism. In particular, it relates to means to attenuate rebound momentum of the bolt assembly. The invention is especially applicable for modifying automatic and semi-automatic firearms for training purposes to provide a weapon which has been converted to fire low-energy ammunition in an unrestrained, blow-back mode.

BACKGROUND OF THE INVENTION

In military and police firearms applications almost all of the ammunition consumed is used in training. For some training purposes, however, normal ammunition is not appropriate. An alternative type of ammunition, which has much lower energy and is represented by U.S. Pat. No. 5,359,937 (adopted herein by reference), fires a low-mass projectile relying on a special, low-energy cartridge designed to provide cycling of suitably modified, recoil-operated automatic and semi-automatic weapons. The cartridge case portion of this low-energy training ammunition expands telescopically on firing to provide force to cycle the firearm. An advantage of low-energy training ammunition is that it has a shorter range and lower penetration capacity than standard ammunition. This permits use of smaller firing ranges as training facilities. If standard ammunition were accidentally employed in these facilities, unexpected dangers would arise from the increased striking power and range of standard ammunition.

Low-energy training ammunition, in combination with certain modifications to the weapon being used, allows normal recoil and cartridge case ejection through a pure blow-back action. Such a system, when firing appropriate marking cartridges, makes for effective close-range, force-on-force training. This system enhances the realism and training value of interactive scenario tactical training because it allows trainees to use their service weapons in a representative manner in exercises simulating, for example, counter-terrorism, close quarters combat, trench clearing, fighting in wooded areas, urban fighting, and protection of dignitaries.

Modifications required to permit cycling of 9 mm automatic or semi-automatic weapons while firing low-energy ammunition, for example, generally include replacing or modifying the barrel and sometimes replacing or adding one or two other components, depending on the weapon involved. Such modifications are exemplified by U.S. Pat. Nos. 5,983,773; 6,276,252 and 6,442,882. These modifications may also serve to increase safety because the calibre of the substitute training barrel may be smaller than the diameter of the projectile in standard 9 mm ammunition. If an attempt is made to chamber a standard cartridge in such a training-adapted firearm, the barrel will not normally admit entry of the standard projectile. This ensures that such converted weapons cannot fire standard, live ammunition.

The same approach can be adopted for converting automatic 5.56 mm gas-operated firearms, for example, to fire low-energy training ammunition. However, using a bore diameter different than 5.56 mm to prevent the chambering of normal service ammunition involves modifications to the weapon that can become prohibitively expensive. U.S. Pat. No. 6,625,916, the contents of which are incorporated herein by reference has overcome this problem in M16A2 rifles and carbines made by the Colt's Manufacturing Company, LLC, for example, by limiting the modifications to the bolt carrier assembly. Safety is ensured by having a training bolt carrier assembly, comprising in part a training bolt having a recess on its bearing face which accommodates low-energy training cartridges while ensuring that conventional ammunition does not seat, thereby avoiding the accidental firing of live ammunition. This same live fire exclusion safety feature can also be applied to similar weapons such as, for example, the 5.56 mm FNC assault rifle made by FN Herstal S.A. of Belgium.

When firing standard ammunition, with its abundant associated energy, it is necessary in many weapons to lock the barrel to the slide (for pistols), or to the bolt assembly for gas-operated automatic rifles, during the first portion of the firing cycle. These parts must be locked together for a period of time long enough for the projectile to exit the barrel muzzle while the breech is still closed. This allows the chamber pressure to drop before the breech opens to extract and eject the spent cartridge case. In rifles and carbines, the locking mechanism that couples the barrel to the bolt assembly for this first portion of the recoil process, and then releases said bolt assembly, is activated usually with the aid of a camming interface between the bolt and the bolt carrier assembly. Upon unlocking, the bolt carrier assembly continues its rearward travel until, after the spent cartridge case has been ejected, it returns under the pressure of the recoil spring to pick-up and chamber the next cartridge from the magazine, en route to its in-battery position.

In a training system using low energy cartridges, it is necessary to omit this barrel locking mechanism and, by so doing, the recoil action becomes pure blow-back of the bolt carrier assembly. This must be done because there is not enough energy in low-energy training cartridges, as represented by U.S. Pat. No. 5,359,937 to furnish sufficient recoil to unlock the barrel from the bolt carrier assembly in their standard configurations.

In the 5.56 mm FNC assault rifle, after replacing the standard bolt carrier assembly by a training bolt carrier assembly to permit the weapon to fire low-energy training cartridges, the absence of a locking mechanism between the barrel and the bolt assembly allows the recoiling bolt assembly to bounce off the base of the cartridge case, after chambering of the low-energy training cartridge in full automatic or three-round burst modes. The resulting, unwanted rebound sometimes leads to "short cycling" of the second or subsequent rounds, wherein the weapon misfires. Such rebound disrupts the synchronization of the firing cycle, resulting in a possible misfire since, in this instance, if the hammer is activated to hit the firing pin while the bolt carrier assembly is rebounding backward, it may not reach the cartridge primer. It is, therefore, an objective of this invention to provide, for the FNC 5.56 mm assault rifle when converted to fire low energy training ammunition, a means of attenuating possible rebound of the bolt when it chambers the cartridge.

It is a further objective of this invention to extend this method of rebound attenuation to other automatic and semi-automatic weapons of the blow-back class generally, and particularly weapons converted to fire low-energy training cartridges. While the invention is preferably directed to gas-operated automatic and semi-automatic weapons, as typified by the FN Herstal's FNC assault rifle, converted to fire low-energy training ammunition as represented by U.S. Pat. No. 5,359,937, the invention is also applicable to all blow-back automatic weapons where there is a need to ensure that the bolt or equivalent will not bounce or rebound off the base of the cartridge case during the feeding cycle so as to cause a misfire.

The invention in its general form will first be described, and then its implementation in terms of specific embodiments will be detailed with reference to the drawings following hereafter. These embodiments are intended to demonstrate the principle of the invention and the manner of its implementation. The invention in its broadest and more specific forms will be further described and defined, in each of the individual claims which conclude this specification.

SUMMARY OF THE INVENTION

According to one aspect of the invention, a unitary bolt carrier assembly with a bolt is provided for an automatic firearm operating in blow-back mode wherein the bolt carrier assembly is slideably mounted in the receiver for shifting between a first position wherein the bolt is in-battery against at the breech and a second position wherein the bolt in its bolt carrier assembly is removed from the breech while cycling. A weight means is provided which is slideably mounted to move in a containment space that travels with the bolt carrier assembly while the weapon is cycling in blow-back mode. When the weapon is cycling with the bolt carrier assembly having moved rearwardly away from the breach to the limit of its travel, the weight means will slide in its containment space in a direction away from the breech to the limit permissible and then so remain at that location on the return stroke until the bolt is again at the in-battery position. When the bolt carrier assembly has returned to the in-battery position the weight means will slide forwardly in its containment space towards the breech, bearing against the bolt carrier assembly and reducing the tendency for "bounce" to occur when in the in-battery position. The result is thereby to increase the dwell-time for the bolt when it is at the in-battery position during automatic firing, allowing sufficient time to ensure that the firing pin will effectively advance to fire a round.

According to a further aspect of the invention there may be a guide rod mounted on a seat within the weapon and/or its receiver and extending forwardly for guiding the bolt carrier assembly in moving between its first and second positions within the receiver. A cylinder sleeve with pierced rearward and forward end walls is carried by the bolt carrier assembly and mounted for sliding displacement on the guide rod. The cylinder sleeve is displaced from axial alignment with the bolt. A return spring is mounted on the guide rod, extending between the rearward seat at one end and a mid-mounted wall in the cylinder, at the other end. The weight means is dimensioned to slide on the rod within the portion of the cylinder sleeve, not occupied by the return spring. Thus the weight means can move independently of the return spring. The forward portion of the interior of the cylinder sleeve provides the containment space for the weights. The weights, being mounted separately from the return spring, can be of a larger diameter without encountering interference from the spring.

Preferably there a cushioning means, such as a spring, is positioned between the weight means and the forward end wall of the cylinder sleeve to cushion the weight means when it shifts forward. Optionally, multiple weights may be employed, all slideably mounted on the guide rod when a guide rod is present. Washers may be located between these weights and also mounted for sliding displacement on the guide rod. When made of polymeric material, such washers can also provide a cushioning effect, thereby also serving as a cushioning means.

The invention is of particular use when applied to a conversion kit for an automatic firearm, said automatic firearm having in its standard form:

a) a standard barrel and a standard chamber of respective given diameters that are dimensioned to fire standard ammunition, said standard ammunition comprising a cartridge with a projectile and a cartridge case which are of a diameter that is substantially equal to the diameter of the said chamber;

b) a standard receiver into which the barrel is mounted;

c) a bolt carrier assembly comprising a bolt carrier, and a bolt with a standard firing pin and bolt recess with a face through which the firing pin will operate by advancement into said recess upon firing, The training kit for operation of the firearm on the basis of a blow-back action then comprises:

d) a unitary training bolt carrier assembly including a bolt, a firing pin and a carrier fixed for movement as a unit, said firing pin being mounted so as to be axially aligned with said chamber, said training bolt carrier assembly being slidingly mounted in said receiver for shifting during cycling of the weapon between a first position wherein the bolt is in-battery against said breech and a second position wherein said training bolt carrier assembly is fully removed from the breech while cycling in a full blowback mode; and e) weight means slideably mounted within a containment space that travels with the bolt carrier assembly for sliding motion with respect to said training bolt carrier assembly, whereby, when the weapon is cycling the training bolt carrier assembly and referenced components all move as described above.

The invention is of particular use when a conversion is effected of a standard firearm having a standard barrel, a standard receiver into which the barrel is mounted and a standard chamber of respective given diameter that is dimensioned to fire standard ammunition having a cartridge case which is of a diameter that is substantially equal to the diameter of the chamber. In this application the standard bolt carrier assembly is replaced by a training bolt carrier assembly comprising a training bolt carrier, a training bolt with a standard firing pin and a training bolt recess with a face through which the firing pin will operate by advancement into said recess upon firing. The training bolt recess is dimensioned or shaped to exclude the seating of a standard cartridge case head and consequently precluding the firing of standard ammunition while allowing the seating of a training low-energy cartridge having a case head of matching diameter.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
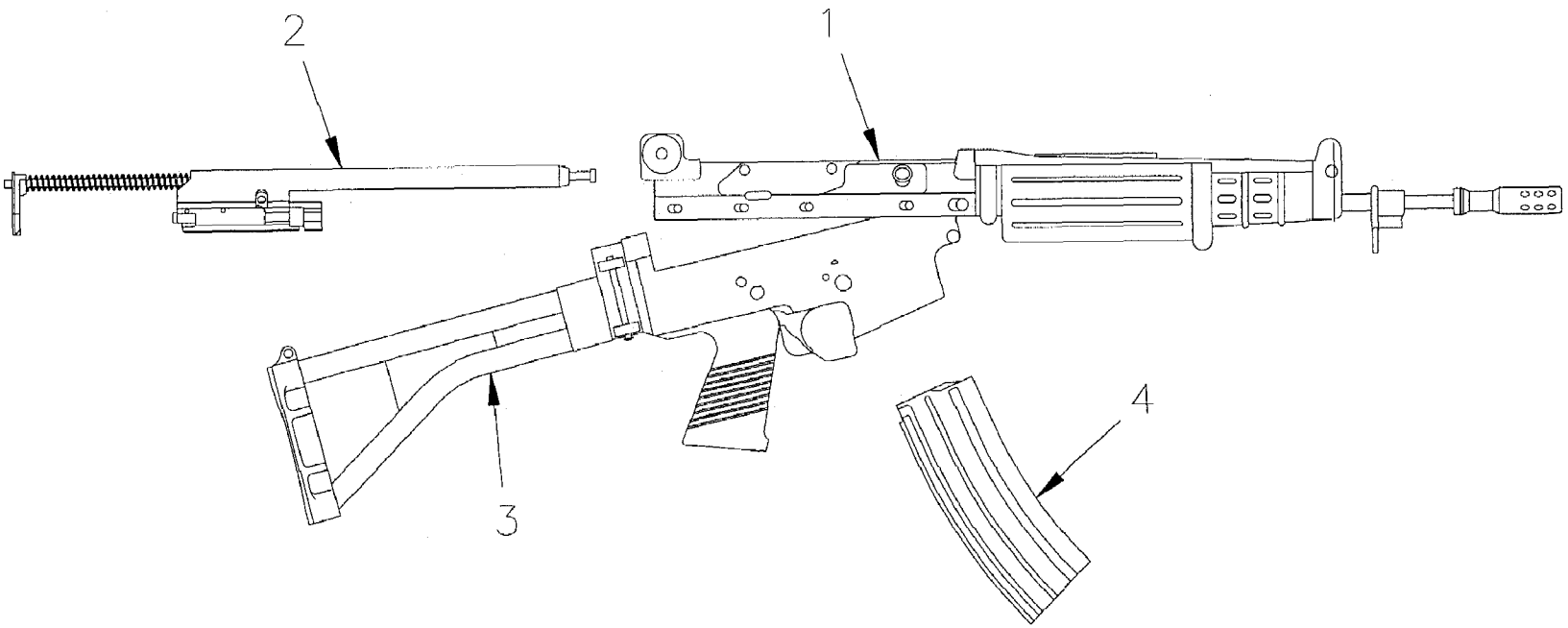
FIG. 1 shows the major components of a typical prior art rifle in the class of FN Hertal's FNC gas-operated assault rifles.

In FIG. 1 the four major groups of a typical prior art rifle in the class of 5.56 mm FNC gas-operated assault rifles are shown: barrel-receiver group 1, bolt carrier assembly 2, butt group 3, and magazine 4. According to the invention, in its conversion variant, only bolt carrier assembly 2 of the prior art will be altered to convert the prior art weapon to a training configuration that will fire a recoil-activating low-energy telescopically expanding training cartridge, as represented by U.S. Pat. No. 5,359,937 or 5,492,063 in a 5.56 mm version (the latter shown as training cartridge 26 in FIG. 6).

Figure 2:
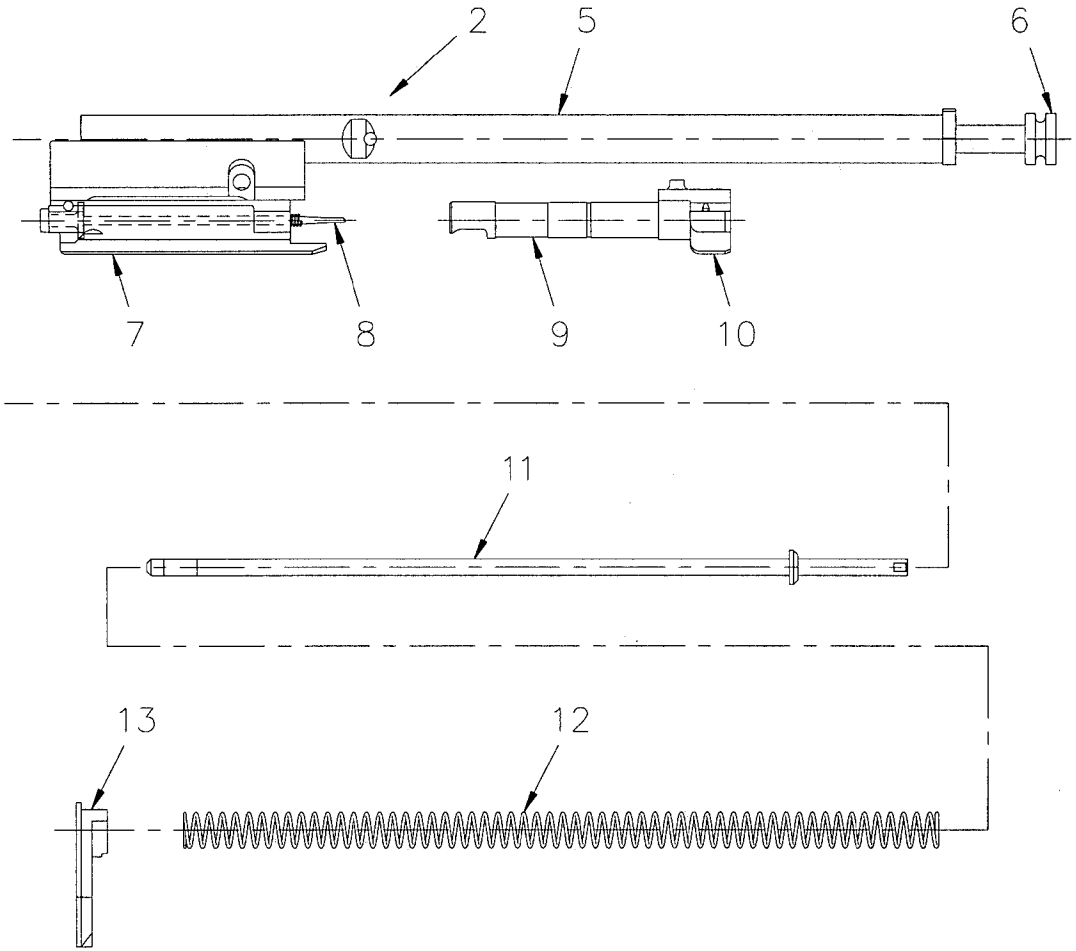
FIGURE 2 PRIOR ART
FIG. 2 is an exploded view of the prior art bolt carrier assembly of FIG. 1.
Figure 3:
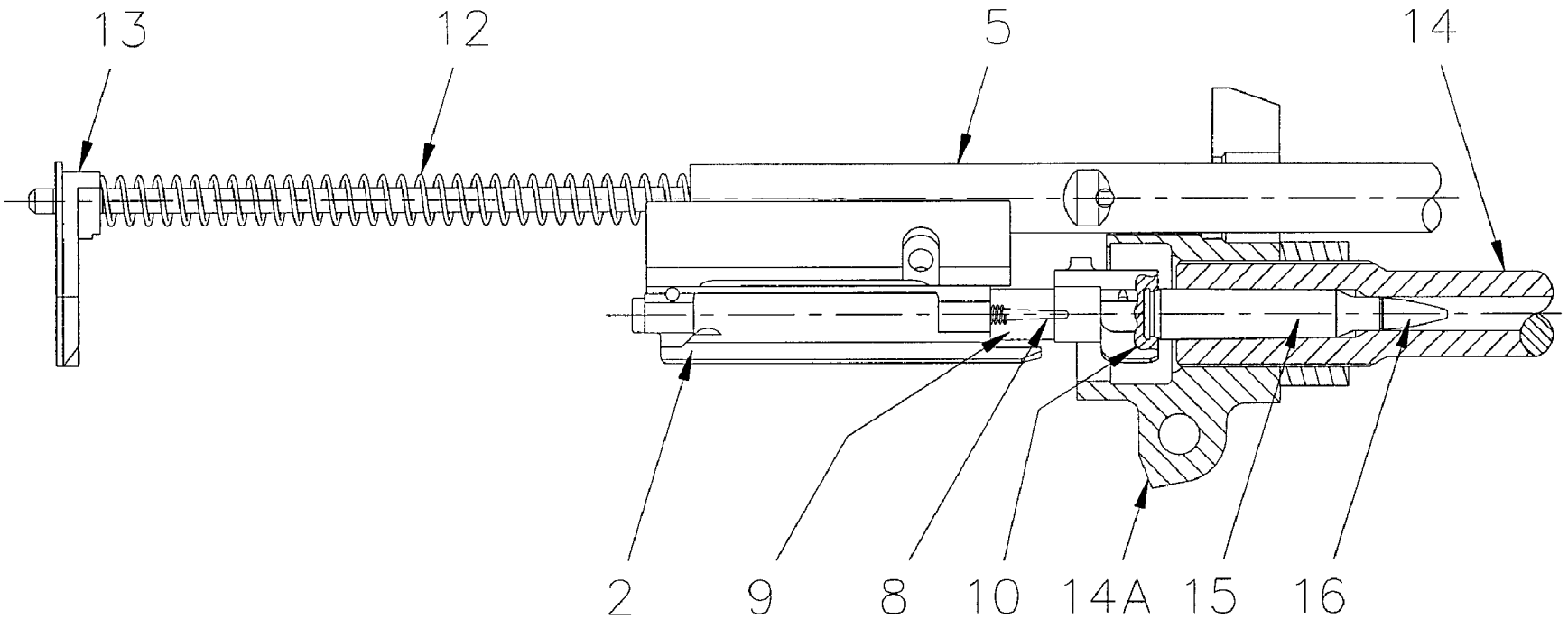
FIGURE 3 PRIOR ART
FIG. 3 is a side cross-section view of portions of the barrel, receiver and bolt carrier assembly of FIG. 1 when in-battery.

FIG. 2 is an exploded view of the prior art bolt carrier assembly 2 shown in FIG. 1. Its principal components are piston 5 comprising piston head 6, bolt carrier 7, firing pin 8, bolt 9 comprising lugs 10, guide rod 11, return spring 12, and stop plate 13. Stop plate 13 is anchored in/barrel-receiver group 1 (see FIG. 1). The bolt carrier assembly 2 is shown in FIG. 3 in its assembled form in relation to the barrel 14 of barrel-receiver group 1 when the weapon is in-battery and ready to fire.

When in-battery, bolt 9 has rotated such that lugs 10 are locked into matching lugs (not shown) on barrel extension block 14A of barrel-receiver group 1. This is accomplished due to the presence of a guide lug (not shown) protruding on the side of the bolt 9 interfacing with a camming slot machined in the bolt carrier 2 to cause the rotation of the bolt 9 to allow locking lugs 10 into their locked position (a standard feature on this type of weapon) with the matching lugs on barrel extension block 14A. This locking prevents rearward motion of bolt assembly 9 until such time as bullet 16 of service cartridge 15 travelling down the barrel passes the gas port (not shown) to allow the combustion gases to enter the weapon's gas block (not shown) and activate piston 5 to initiate the recoil portion of the firing cycle by compressing the return spring 12. The piston being structurally attached to bolt carrier 2, this movement of the piston, initiating the recoil motion, pulls the bolt carrier 2 backwards, engaging the reverse camming effect on the bolt guide lug (not shown), and thereby rotating the bolt 9 in such a way as to unlock it from the barrel extension block 14A. The locking and unlocking of the bolt assembly 9 is designed in such a way as to eliminate any bounce or rebound of bolt assembly 9 when the bolt arrives at its in battery position, allowing time for firing pin 8 to strike the cartridge primer (not shown).

Figure 4:
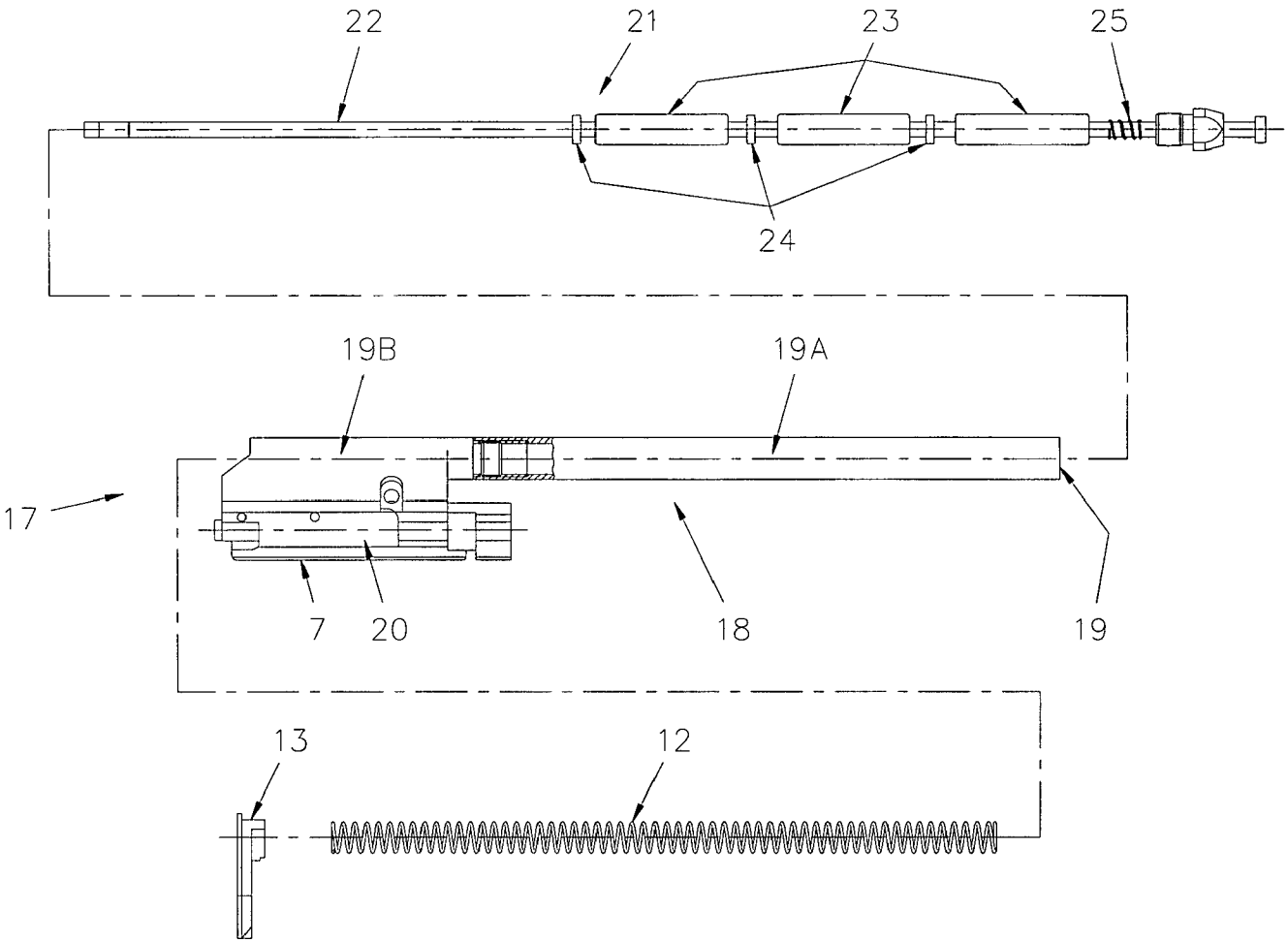
FIG. 4 is an exploded view of a training bolt carrier assembly of the invention.

FIG. 4 is an exploded view of training bolt carrier assembly 17 of the invention which replaces standard bolt carrier assembly 2 when a gas-operated automatic weapon in the class of 5.56 mm FN Herstal FNC gas-operated assault rifle is modified to fire low-energy training ammunition as represented by U.S. Pat. No. 5,359,937. Its principal components are training bolt carrier assembly 18, including guide rod 21, and piston cylinder 19, return spring 12 and stop plate 13. It will be noted that the training bolt carrier assembly 18 is connected to move as a single piece assembly comprising training bolt carrier 7, training cylinder 19 and training bolt 20, rather than the bolt being a separately moveable piece as described above for the prior art. In this particular configuration, the training cylinder 19 is used as a confinement for the attenuation device rather than performing a gas-operated piston function, since the gas pressure operating mode is redundant while using a low-energy training cartridge and blow-back mode.

Training cylinder 19 is a two-piece assembly consisting of a forward compartment 19A and rearward compartment 19B, said compartments being coupled together at a partitioning wall with a central opening to receive the guide rod 22. Rearward compartment 19B contains a rear end circular perforation just large enough to permit training guide rod 22 to pass through it and serves as the rearward containment for the training guide rod assembly 21 which comprises training guide rod 22, slideable weights 23, slideable washers 24, and cushioning spring 25.

Figure 5:
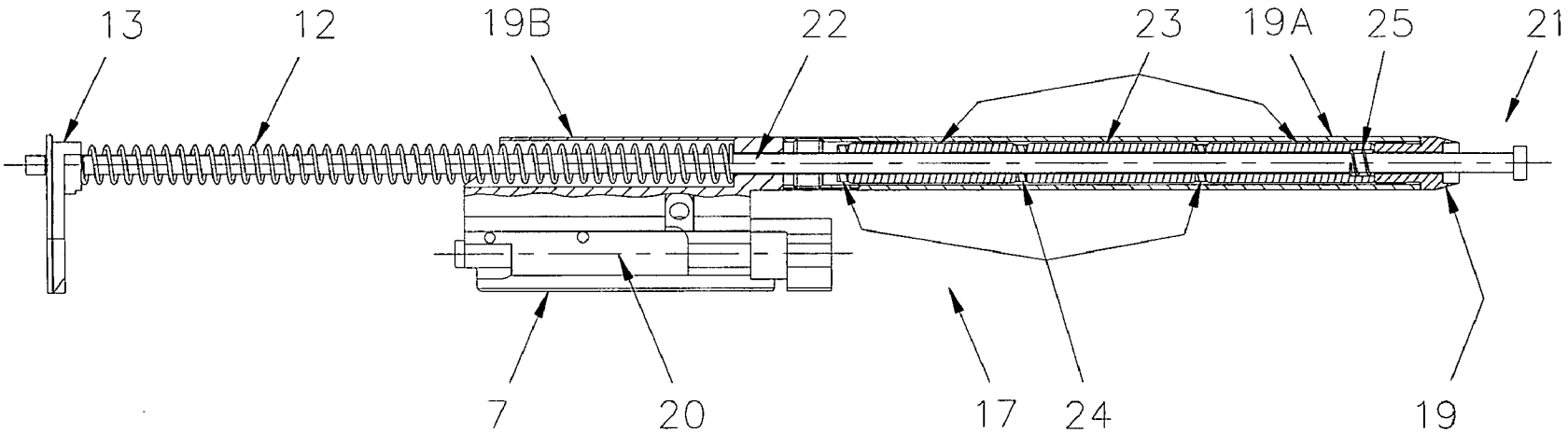
FIG. 5 is a side cross-section of a fully assembled training bolt carrier assembly of FIG. 4.

A fully assembled training bolt carrier assembly 17 is depicted in FIG. 5. Training guide rod assembly 21 is inserted into training cylinder 19 such that slideable weights 23 and slideable washers 24 are contained in forward compartment 19A while return spring 12 is located in rearward compartment 19B. Slideable weights 23 and slideable washers 24 contain central openings that allow them to slide freely when assembled on training guide rod 22. Cushioning spring 25, which is relatively weak, biases the slideable weights 23 and slideable washers 24 in forward compartment 19A away from the breech until the weapon is in-battery. When the weapon is in-battery cushioning spring 25 becomes fully compressed.

Figure 6:
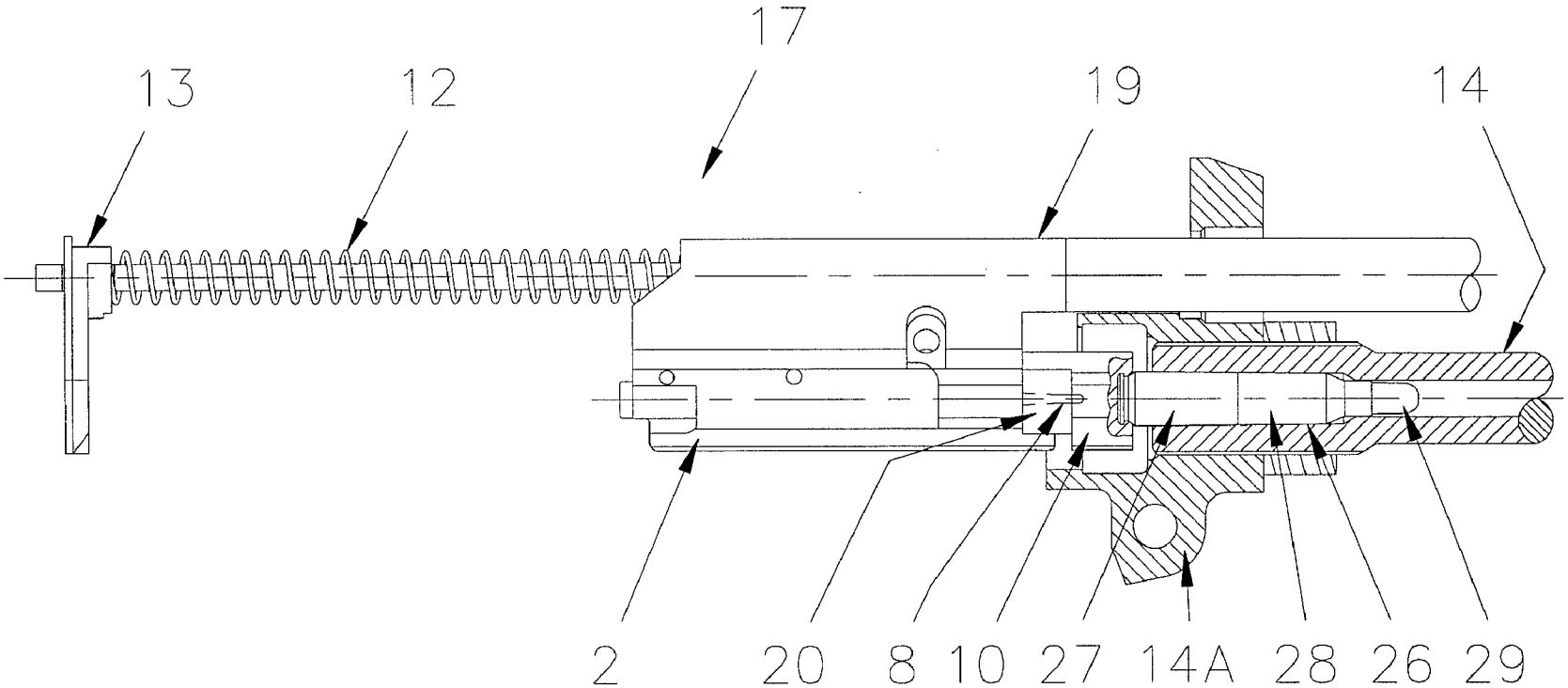
FIG. 6 is a side cross-section view of portions of the barrel, receiver and training bolt carrier on the invention when in-battery.

Training bolt carrier assembly 17 is shown in FIG. 6 in relation to the barrel 14 of barrel-receiver group 1 when the weapon is in-battery ready to fire low-energy training cartridge 26. This low-energy training cartridge comprises training case 27, training sabot 28 and training projectile 29. There is no locking between training bolt 20 and barrel extension block 14A because lugs 10 have been modified so as not to engage the lugs (not shown) on standard barrel extension block 14A. It is necessary to do this because there is insufficient energy in low-energy training cartridge 26 to function the weapon in its prior art configuration. By omitting the bolt locking mechanism, the recoil action becomes a simple blow-back of training bolt carrier assembly 17.

Figure 7:
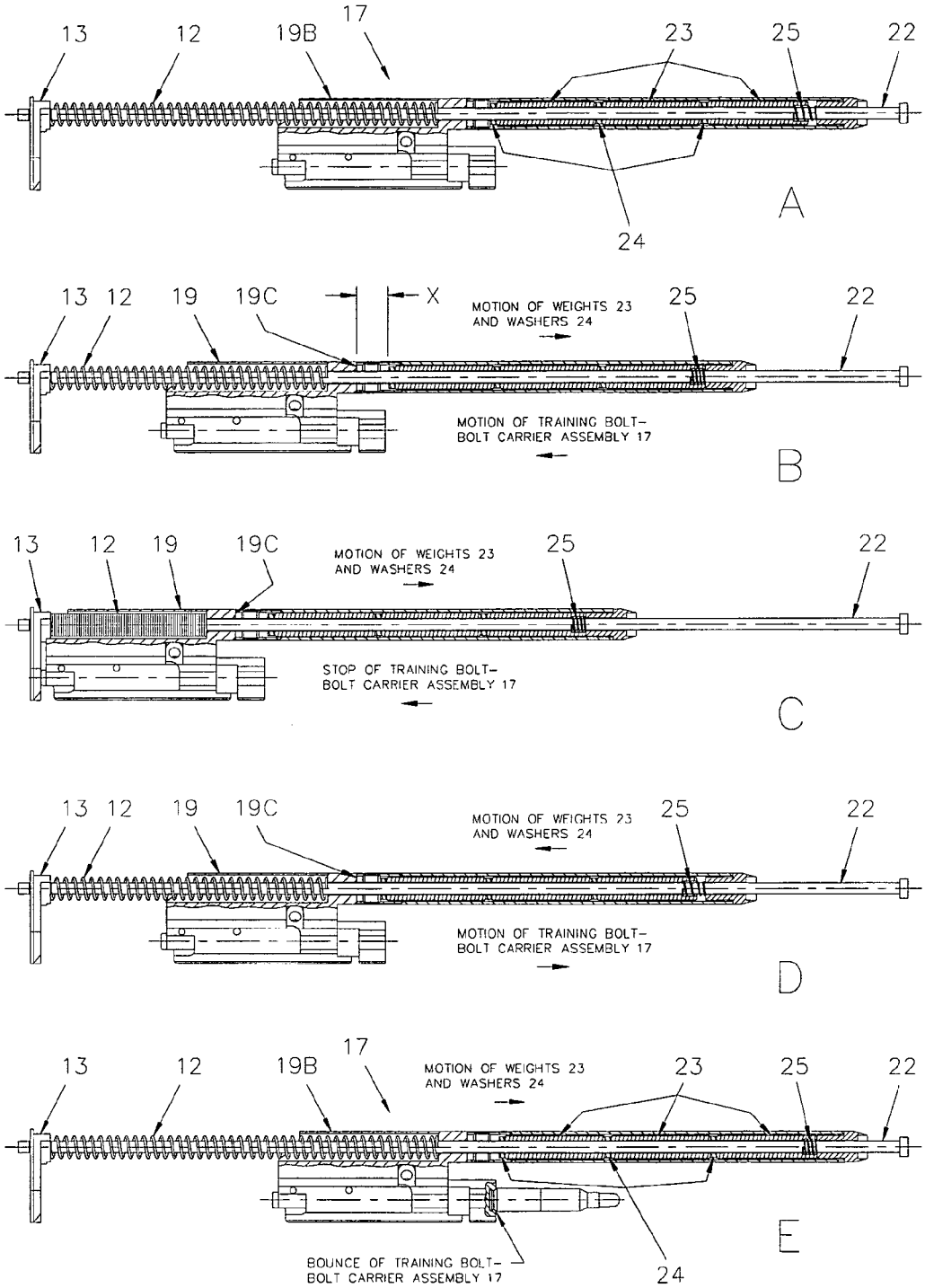
FIGS. 7A through 7E show a side cross section of a training bolt carrier assembly comparatively at five different stages of the firing cycle: when in-battery, before a first firing; at the halfway point of recoil cycle; at the end of recoil cycle before the weights shift; at the halfway point of return cycle and at the moment just prior to firing.

The problem arising from the tendency of the bolt to bounce off the base of the training case 27 is overcome by introducing one or more slideable weights 23 into training bolt carrier assembly 17 that will sufficiently neutralize the bounce of said training bolt carrier assembly at the moment it hits the base of the training case 27. FIG. 7 shows comparatively training slide-bolt assembly 17 at five different stages during the firing cycle of a 5.56 mm FN Herstal FNC gas-operated assault rifle modified to fire low-energy training ammunition as represented by U.S. Pat. No. 5,359, 937. In FIG. 7A, the weapon is in-battery and ready to fire. Cushioning spring 25 is sufficiently strong to push slideable weights 23 and slideable washers 24 rearward so that they butt against each other and press against the forward edge 19C of the rearward compartment 19B.

In FIG. 7B, training bolt carrier assembly 17 is approximately halfway into the recoil portion of its firing cycle. Cushioning spring 25 is not strong enough to resist the combined inertia and resulting setback of slideable weights 23 and becomes compressed. Both weights 23 and washers 24 move with training cylinder 19, but shifted i.e., in a direction to compress cushioning spring 25. The amount of movement of slideable weights 23 and slideable washers 24 within the training cylinder 19 is indicated by the distance "X". Effectively, such weights are slightly delayed in developing a rearward motion by the compression of cushioning spring 25, but move generally with the cylinder 19 in its rearward travel.

In FIG. 7C, training bolt carrier assembly 17 has just reached the end of its rearward motion, as it stops by reason of full compression of the return spring 12 against the stop plate 13. At this point, the training bolt carrier assembly 17 will initiate its return stroke under the action of return spring 12. The slideable weights 23 and slideable washers 24 will then be caught-up by this return motion.

FIG. 7D shows training bolt carrier assembly 17 halfway into its return cycle. Cushioning spring 25 is now fully extended with slideable weights 23 and slideable washers 24 at their rearmost position. The gap "X" has been reduced to zero by the movement of slideable weights 23 and slideable washers 24 within their containment space. The slideable weight means 23 and slideable washers 24 will remain butted against the forward end 19C of the rearward compartment 19B on the return stroke until the bolt is again at the in-battery position.

Finally, in FIG. 7E, training bolt carrier assembly 17 has returned to its in-battery location and would bounce off the base or head end of the training case 27 at the moment of contact. However, according to the invention, at precisely this moment, slideable weights 23 and slideable washers 24 will move to compress cushioning spring 25, opposing the bounce. By judiciously selecting the weight and size of slideable weights 23 and slideable washers 24, as well as the distance "X" they are to move, the tendency for rearward motion of training bolt carrier assembly 17 to occur will be momentarily arrested by the forward motion of slideable weights 23 and slideable washers 24. The firing pin will then be able to initiate firing permitting the firing cycle to be completed as designed and firing of the next round automatically to proceed in a normal fashion.

In the preferred embodiment there are three slideable weights 23 of identical size and weight made of steel and three slideable washers 24 of identical size and weight made of low friction plastic. A satisfactory distance "X" with this combination of weights and washers has been found to be approximately ⅛ inch. The number of weights and washers and what they are made of can be any number and any material. The inclusion of slideable washers 24 is optional. They provide further cushion if made of cushioning material. The numbers, sizes and materials selected for the weights and washers in the preferred embodiment were based on convenience and cost of production. This design has been tested many times in FN Herstal FNC rifles converted to fire low-energy training ammunition to demonstrate the elimination of training bolt carrier assembly bounce off the base of training case 27 with complete success.

The invention, while demonstrated by the FN Herstal FNC assault rifle, is applicable to all blow-back firearms wherein bouncing of the bolt carrier assembly or equivalent assembly off the base of the cartridge case or breech may cause a misfire.

Figure 8A:
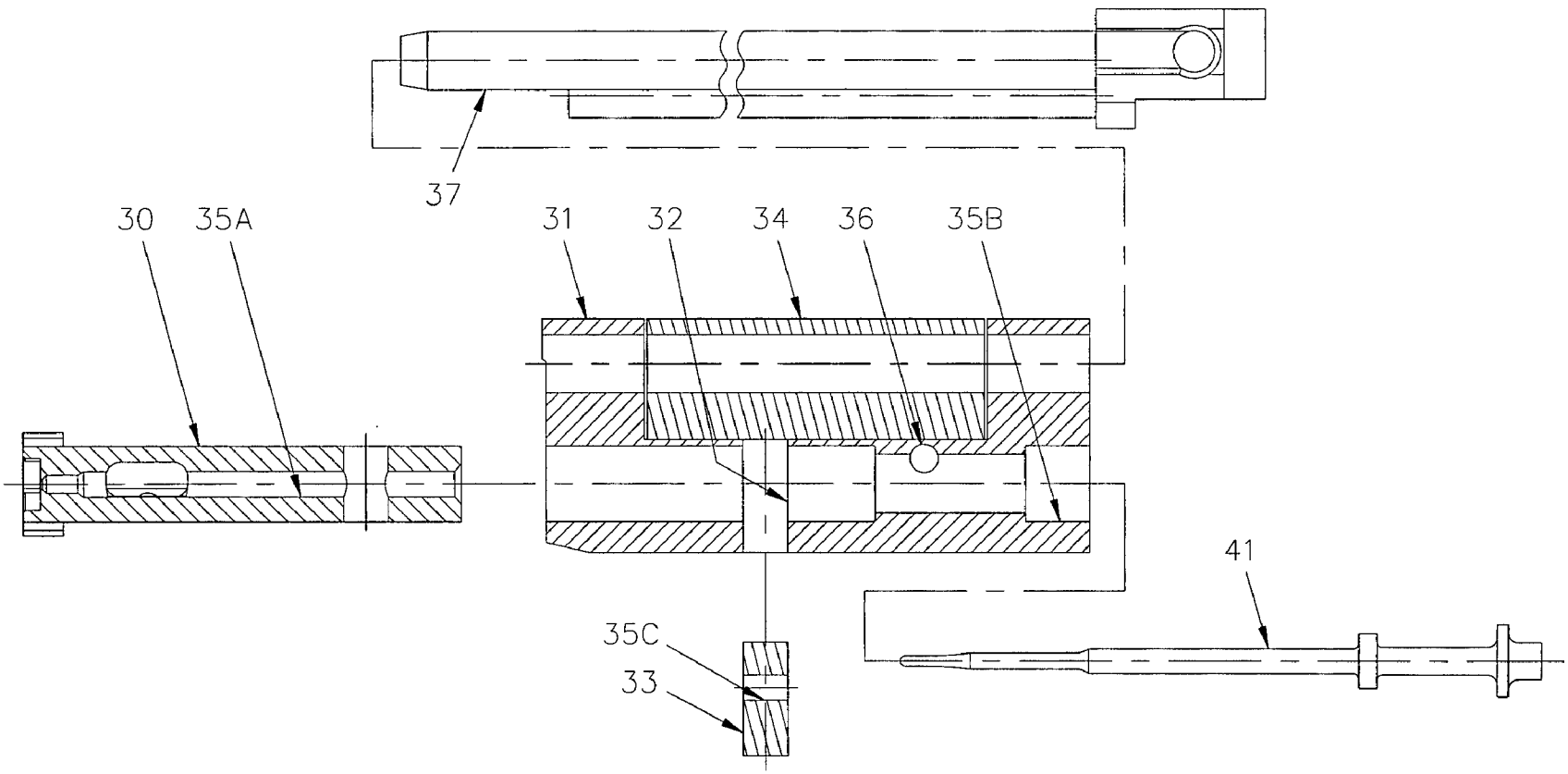
FIG. 8A is an exploded view of an alternate training bolt carrier assembly (reversely oriented to the components of FIGS. 1–7).
Figure 8B:
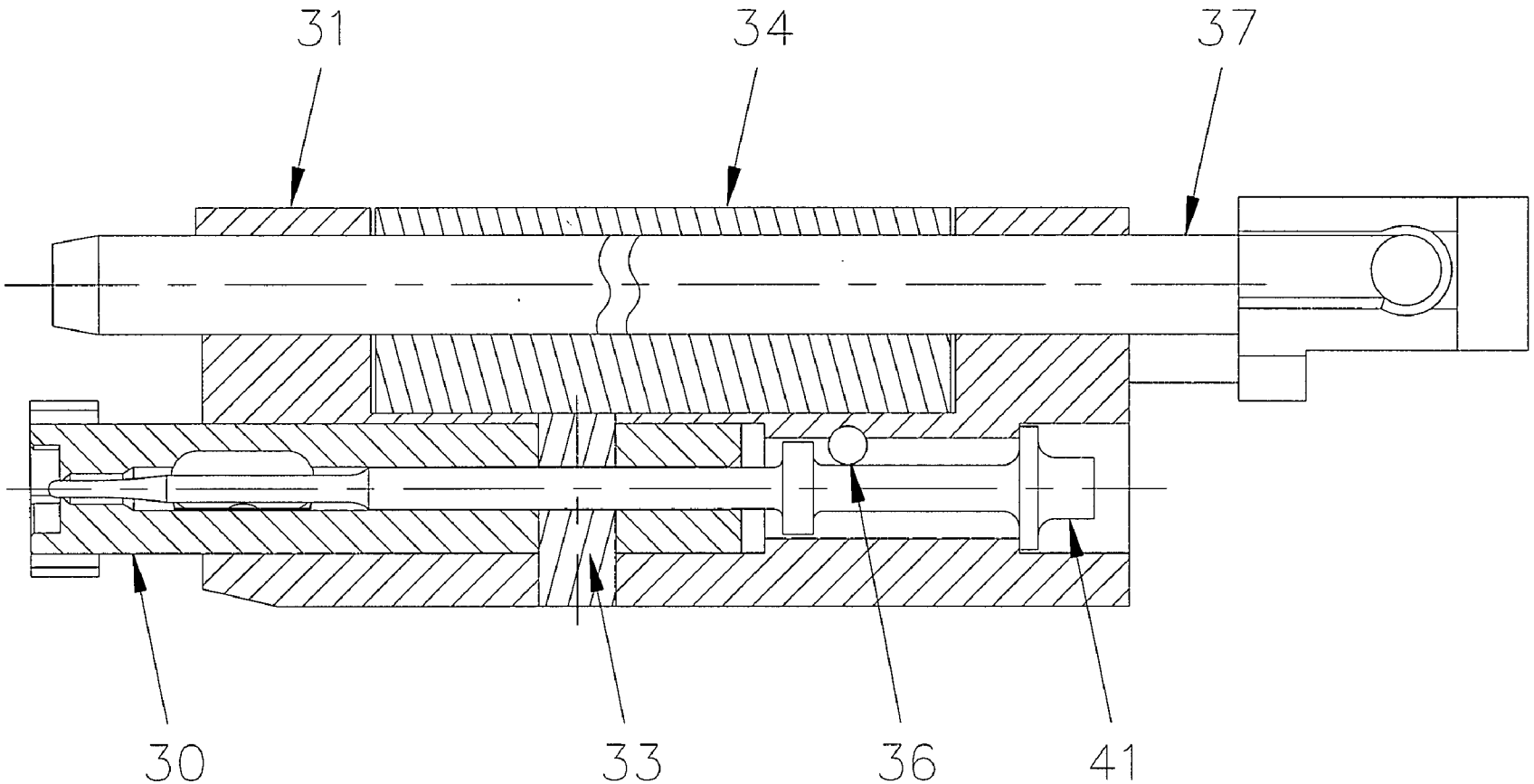
FIG. 8B is a side cross-section of the alternate, fully assembled, training bolt carrier assembly of FIG. 8A.

FIGS. 8A and 8B show respectively a disassembled and an assembled training bolt carrier assembly designed for Heckler & Koch SA80A2 gas-operated assault rifle. This second embodiment has also been extensively tested to demonstrate the elimination of training bolt carrier assembly bounce off the base of training case 27 with complete success.

FIG. 8A is an exploded view of this alternate bolt carrier assembly consisting of training bolt 30, training bolt carrier 31, training bolt carrier locking pin 33, single slideable weight 34, standard recoil rod assembly and standard firing pin 41. The training bolt carrier 31 has provisions to accommodate training bolt locking pin 33 at location 32, firing pin locking device (not shown) at location 36 and a recess to accommodate single slideable weight 34 in the containment space situated at location 42. Training bolt carrier 31 and single slideable weight 34 are drilled to accommodate standard weapon recoil rod 37. Training bolt 30, training bolt carrier 31 and training bolt carrier locking pin 33 are machined to accept standard firing pin 41. By mounting the slideable weights 34 on the rod 37 for a low friction displacement, the weights 34 will shift more rapidly and be better synchronized to neutralize the effect of a potential bounce.

FIG. 8B shows the fully assembled alternate training bolt carrier assembly described in FIG. 8A. The attenuation device principle is identical to the original embodiment. However, according to experience acquired through tests, no springs or washers are required.

CONCLUSION

The foregoing constitutes a description of specific embodiments showing how the invention may be applied and put into use. These embodiments are only exemplary. The invention in its broadest and more specific aspects is further described in the claims which follow. These claims, and the language used therein, are to be understood in terms of the variants of the invention which has been described. They are not to be restricted to the variants, but are to read as covering the full scope of the invention as is implicit within the invention and the disclosure that has been provided herein.

The embodiments of the invention in which an exclusive property are claimed are as follows:

1. An automatic firearm operating on the basis of a blow-back action, said firearm having:

1) a barrel with a breech and a chamber for receiving a round to be fired,
2) a receiver into which the barrel is mounted, and
3) a unitary bolt carrier assembly including a bolt, a firing pin and a carrier fixed for movement as a unit, said firing pin being axially aligned with said chamber, said assembly being slidingly mounted in said receiver for shifting during cycling of the weapon between a first position wherein the bolt is in-battery against said breech and a second position wherein said bolt carrier assembly is fully removed from the breech while cycling in a full blowback mode;
4) a return spring, seated within the weapon for urging the bolt carrier assembly towards the in-battery position when the weapon is cycling; and 5) weight means slideably mounted within a containment space that travels with the bolt carrier assembly for sliding motion with respect to said bolt carrier assembly, whereby, when the weapon is cycling with the bolt carrier assembly having moved rearwardly away from its first position against said breech, to said second position, said weight means will slide away from the breech in its containment space and so remain on the return stroke of the cycle until the bolt is again at the in-battery position, and when the bolt carrier assembly has returned to the in-battery position, the weight means will slide forwardly in its containment space towards the breech to the forward limit of its travel, bearing against the bolt carrier assembly when it comes to the in-battery position and thereby increasing the dwell-time for the bolt when it is in the in-battery position during automatic firing, allowing time to ensure that the firing pin will effectively advance to fire a round.

2. An automatic firearm as in claim 1 wherein said weight means is displaced laterally from axial alignment with the firing pin.

3. An automatic firearm as in claim 1 wherein said weight means is displaced from containment by said return spring.

4. An automatic firearm as in claim 1 comprising:

a) a guide rod mounted on a seat within the receiver for guiding the bolt carrier assembly in moving between said first and second positions;

b) a cylinder sleeve having pierced rearward and forward end walls and a mid-wall carried by the bolt carrier assembly and mounted through said pierced rearward and forward end walls, for sliding displacement on said guide rod extending through said mid-wall; and c) said return spring being mounted on said rod and extending from said seat and towards the mid-wall of the cylinder sleeve to bias the cylinder sleeve to effect said return stroke;

wherein the weight means is mounted within the cylinder sleeve, free to slide on said rod within said cylinder sleeve, moving independently of said return spring.

5. An automatic firearm as in claim 4 comprising cushioning spring means positioned between the weight means and the forward end wall of the cylinder sleeve.

6. An automatic firearm as in claim 5 wherein the weight means compromises a plurality of weights slideably mounted on said guide rod.

7. An automatic firearm as in claim 6 comprising washers located between said plurality of weights and mounted for sliding displacement on said guide rod.

8. An automatic firearm as in claim 4 wherein the weight means compromises a plurality of weights slideably mounted on said guide rod and further comprising washers located between said plurality of weights and mounted for sliding displacement on said guide rod wherein the washers are made of a polymeric plastic.

9. An automatic firearm as in claim 1 having:

a) a standard barrel and a standard chamber of respective given diameters that are dimensioned to fire standard ammunition, said standard ammunition comprising a cartridge with a projectile and a cartridge case which are of a diameter that is substantially equal to the diameter of the said chamber;

b) a standard receiver into which the barrel is mounted;

c) a training bolt carrier assembly comprising a training bolt carrier, a training bolt with a standard firing pin and training bolt recess with a face through which the firing pin will operate by advancement into said recess upon firing, said training bolt recess being dimensioned or shaped to exclude the seating of a standard cartridge case head and consequently precluding the firing of standard ammunition while allowing the seating of a training low-energy cartridge case head of matching diameter.

10. A conversion kit for an automatic firearm, said automatic firearm having in its standard form:

a) a standard barrel and a standard chamber of respective given diameters that are dimensioned to fire standard ammunition, said standard ammunition comprising a cartridge with a projectile and a cartridge case which are of a diameter that is substantially equal to the diameter of the said chamber;

b) a standard receiver into which the barrel is mounted;

c) a bolt carrier assembly comprising a bolt carrier, and a bolt with a standard firing pin and bolt recess with a face through which the firing pin will operate by advancement into said recess upon firing, said training kit for operation of the firearm on the basis of a blow-back action comprising:

a training bolt carrier assembly comprising:

(i) a unitary training bolt carrier assembly including a bolt, a firing pin and a carrier fixed for movement as a unit, said firing pin being mounted so as to be axially aligned with said chamber, said training bolt carrier assembly being slidingly mounted in said receiver for shifting during cycling of the weapon between a first position wherein the bolt is in-battery against said breech and a second position wherein said training bolt carrier assembly is fully removed from the breech while cycling in a full blowback mode; and (ii) weight means slideably mounted within a containment space that travels with the bolt carrier assembly for sliding motion with respect to said training bolt carrier assembly whereby, when the weapon is cycling with the training bolt carrier assembly having moved rearwardly away from its first position against said breech, to said second position, said weight means will slide away from the breech in its containment space and so remain on the return stroke of the cycle until the bolt is again at the in-battery position, and when the training bolt carrier assembly has returned to the in-battery position, the weight means will slide forwardly in its containment space towards the breech to the forward limit of its travel, bearing against the training bolt carrier assembly when it comes to the in-battery position and thereby increasing the dwell-time for the bolt when it is in the in-battery position during automatic firing, allowing time to ensure that the firing pin will effectively advance to fire a round.

11. A conversion kit as in claim 10 wherein comprising a training bolt carrier, a training bolt with a standard firing pin and training bolt recess with a face through which the firing pin will operate by advancement into said recess upon firing, said training bolt recess being dimensioned or shaped to exclude the seating of a standard cartridge case head and consequently precluding the firing of standard ammunition while allowing the seating of a training low-energy cartridge case head of matching dimensioned or shape.

12. A conversion kit as in claim 11 wherein said training bolt recess is circular, having a diameter to exclude the seating of a standard cartridge case head and consequently precluding the firing of standard ammunition while allowing the seating of a training low-energy cartridge case head of matching diameter.

* * * * *